US009930983B2

(12) United States Patent
Ballard

(10) Patent No.: US 9,930,983 B2
(45) Date of Patent: Apr. 3, 2018

(54) HAT HOLDING DEVICE

(71) Applicant: Rodney Ballard, Valrico, FL (US)

(72) Inventor: Rodney Ballard, Valrico, FL (US)

( * ) Notice: Subject to any disclaimer, the term of this patent is extended or adjusted under 35 U.S.C. 154(b) by 0 days.

(21) Appl. No.: 14/268,546

(22) Filed: May 2, 2014

(65) Prior Publication Data

US 2014/0332573 A1 Nov. 13, 2014

Related U.S. Application Data

(60) Provisional application No. 61/820,448, filed on May 7, 2013.

(51) Int. Cl.
*A47G 25/10* (2006.01)
*A47F 7/06* (2006.01)

(52) U.S. Cl.
CPC ..... *A47G 25/10* (2013.01); *A47F 7/06* (2013.01)

(58) Field of Classification Search
CPC ..... A47G 25/10; A47G 25/48; A47G 25/481; A47G 25/483; A47F 7/00; A47F 7/06; A47B 57/42
USPC ..... 223/85, 90, 91, 93, 96, 120; D6/315
See application file for complete search history.

(56) References Cited

U.S. PATENT DOCUMENTS 1,970,943 A * 8/1934 Morris ..... 223/94
2,337,723 A * 12/1943 Levin ..... 223/96
2,439,355 A * 4/1948 Wollin ..... 223/96
2,470,879 A * 5/1949 Wiggins ..... 211/32
3,100,324 A * 8/1963 Tutino et al. ..... 24/346
3,744,686 A * 7/1973 Levitin ..... 223/96
4,308,981 A * 1/1982 Miura ..... 223/96
4,324,125 A * 4/1982 Jarman et al. ..... 72/479
4,805,782 A 2/1989 Hale et al.
4,927,063 A 5/1990 Fricano
5,038,941 A 8/1991 Bastiaansen
5,566,837 A 10/1996 Lema
6,112,909 A 9/2000 Moseley
6,892,894 B2 5/2005 Aiken
7,040,517 B1 5/2006 Swanson

* cited by examiner

*Primary Examiner* — Ismael Izaguirre
(74) *Attorney, Agent, or Firm* — Global Intellectual Property Agency, LLC; Jordan Sworen

(57) ABSTRACT

Described is a hat holding device having a pair of arms pivotally secured to a housing such that the arms can pivot towards or apart from one another. The opposing ends of the arms attach to gripping members adapted to support the brims of one or more hats arranged in a stacked configuration. A rectangular loop is disposed around the arms of the hat holding device and is used to maintain the holding device in a closed or open configuration. The arms include exterior ridges therealong and are curved such that they are further apart from one another at the gripping member ends. By sliding the loop along the arms and towards the gripping members, the gripping members are forced together in a closed configuration and the ridges resist movement of the loop once positioned. Further provided is a hook pivotally secured to the housing for hanging the device.

22 Claims, 4 Drawing Sheets

HAT HOLDING DEVICE

CROSS REFERENCE TO RELATED APPLICATION

This application claims the benefit of U.S. Provisional Application No. 61/820,448 filed on May 7, 2013, entitled "Cap Grip." The above identified patent application is herein incorporated by reference in its entirety to provide continuity of disclosure.

BACKGROUND OF THE INVENTION

Field of the Invention

The present invention relates to hat holding or storing devices. More specifically, the present invention describes a pair of arms pivotally secured to a housing at a first end and having gripping members at a second end. The gripping members are adapted to hold the brim of one or more baseball hats therebetween so as to hold the hats while retaining the shape of the brims. A securing means comprising a loop disposed around the arms can be used to secure the holding device in a closed configuration for holding the brim of one or more hats. The hat holding device further comprises a hook pivotally connected to the housing for hanging the device on a rod or other similar object.

Many people own and wear a variety of baseball style caps or hats. Baseball hats commonly include logos thereon and display a sports team's colors and emblems. People wear baseball caps for various purposes, including showing support for their favorite sports team or college. Alternatively, people may own baseball caps for functional purposes such as blocking out the sun while outdoors. Others may simply wear a baseball hat as a fashion accessory.

Many people bend the brim of a baseball cap so that it is curved. People may prefer the appearance of a curved brim, or bend the brim in order to better block the sun. However, when a baseball hat is placed in a suitcase with other clothes and personal belongings, or is otherwise placed in a bag for traveling, the brim can bend or flatten and lose the curved shape desired by the user. Further, without an organizer or holding device, a person may lose or misplace his or her baseball hats. While devices are known in the art that disclose hat hangers for storing baseball hats in a contained unit, these organizers consume a significant amount of space and are not well suited for travel. Thus, a portable hat holding device that can be used to store a number of baseball caps is desired.

The present invention describes a hat holding device comprising a pair of arcuate arms pivotally secured at a first end to a housing, and adapted to rotate towards or apart from one another. The second ends of the arcuate arms comprise gripping members having surfaces that face one another such that the brims of one or more baseball caps can be secured therebetween. The holding device can be arranged in an open configuration for insertion of hats, and can be secured in a closed configuration for holding and storing the hats. A securing means is provided and comprises a loop disposed around the pair of arms. The securing means can move along the length of the arms, and as the securing means moves toward the gripping members, the securing means forces the pair of arms, and thus the gripping members, towards one another. The arms further comprise a plurality of ridges thereon that help to maintain the securing means in a particular position along the length of the arms. The hat holding device also includes a hook pivotally secured to the housing that is used to hang the hat holding device on a closet rod or similar object.

Description of the Prior Art

Devices have been disclosed in the prior art that relate to hat racks and hat storage devices. These include devices that have been patented and published in patent application publications. These devices generally relate to hat holding racks adapted to store multiple hats thereon. The following is a list of devices deemed most relevant to the present disclosure, which are herein described for the purposes of highlighting and differentiating the unique aspects of the present invention, and further highlighting the drawbacks existing in the prior art.

One such prior art device is U.S. Pat. No. 6,892,894 to Aiken which discloses a cap rack for storing baseball caps comprising a base having a channel with a plurality of slots therein for receiving cap supports. The cap supports comprise hemispherical supports for retaining the soft-head component of a baseball cap, and a rod section for securing to the channel. The cap rack can be disposed on a wall or similar vertical surface or can be arranged on a horizontal surface. Thus, Aiken fails to disclose a cap support device having a pair of opposing gripping members for securing a plurality of hats therebetween in a stacked orientation. Further, the device of Aiken is not well suited for travel or storage in a suitcase.

U.S. Pat. No. 4,927,063 to Fricano discloses a hat hanger and press having gripping members that are pivotally connected by a spring mechanism. The brim or visor of a cap can be placed between the gripping members and the spring mechanism presses the gripping members against the brim. The gripping members can be curved such that the gripping members can be used to press the brim of the cap into the desired shape. Thus, Fricano does not disclose a hat holding device comprising a pair of arms each having a gripping member thereon that can be secured around multiple hats by means of a securing mechanism comprising a loop disposed around the arms.

U.S. Pat. No. 5,038,941 to Bastiaansen discloses a hat rack for holding baseball hats that holds the hats such that the front portion of each hat is visible. The device comprises an elongated strip or baseplate having a plurality of clamps extending outward therefrom. The clamps comprise a pair of opposed fingers that converge such that the soft head covering of the hat can be secured therebetween. Bastiaansen does not disclose a hat support device that can hold multiple hats in a stacked orientation between a pair of gripping members. Further, the device disclosed by Bastiaansen is adapted to be mounted to a wall or other surface and is not well suited for travel.

U.S. Pat. No. 4,805,782 to Hale et al. discloses a baseball cap shaping and drying support. The device comprises a vertical post disposed on a curved base support, and wherein a clip is arranged on the vertical post. The crown of the baseball cap can be positioned on the base such that the bill of the cap is oriented vertically, and the bill can be secured within the clip on the vertical post. In this position, the crown of the cap is shaped by the base support while the hat is drying. Thus, Hale et al. fails to disclose a hat holding device capable of holding a plurality of hats between a pair of gripping members.

U.S. Pat. No. 5,566,837 to Lema discloses a hat rack comprising a vertical rod having rack sections attached to the vertical rod at intervals and which extend outward therefrom. Each rack section is adapted to store a single cap. Each rack section includes two rods that extend from the vertical rod at angles so as to form a triangular cap support, wherein the two rods are connected by a cross bar for added support. The ends of the rods have upwardly turned ends to capture the brim of a cap placed on the rods in order to maintain the position of the cap on the rack section. Thus, Lema discloses a vertical hat rack with multiple sections for holding individual hats, and does not disclose a pair of gripping members for holding a plurality of hats therebetween.

U.S. Pat. No. 6,112,909 to Moseley discloses a rack for storing baseball hats having an elongated base with attachment rods extending therefrom, and wherein each attachment rod has a cap support on an end thereof. The cap supports have hemispherical shapes sized to securely hold a cap thereon. The base can be disposed in a vertical or a horizontal orientation. Thus, Moseley describes a baseball cap support having a plurality of rods on which hats can be disposed, and Moseley does not disclose a portable device that can be used to maintain the shape of the brims of one or more hats.

Finally, U.S. Pat. No. 7,040,517 to Swanson discloses a hat hanger comprising an elongated cord having a hook at one end that can be secured on a closet rod or similar structure. A plurality of attachment cords are disposed along the elongated cord and each attachment cord is used to secure a baseball hat thereon. The device is able to be stored within a suitcase and can be suspended in a vertical orientation. However, Swanson fails to disclose a hat holding device that can secure the brims of one or more hats in a stacked configuration while retaining the shape of the brims of the hats.

These prior art devices have several known drawbacks. Many devices in the prior art disclose racks or supports having a variety of hooks or clamps for securing hats thereon. These devices are adapted to be mounted on a wall or placed on a table surface and consume a significant amount of space thereon. Thus, these devices are not well suited for travel and cannot easily be placed in a suitcase or backpack. Further, the prior art discloses devices having hooks or rods on which a hat can be placed. However, these devices do not help to maintain the curved shape of the brim and simply provide a place on which a hat can be disposed. Thus, a portable hat holding device that can hold multiple hats while maintaining the curvature of their brims is desired.

In light of the devices disclosed in the prior art, it is submitted that the present invention substantially diverges in design elements from the prior art and consequently it is clear that there is a need in the art for an improvement to existing hat holding devices. In this regard the instant invention substantially fulfills these needs.

SUMMARY OF THE INVENTION

In view of the foregoing disadvantages inherent in the known types of hat supports and racks now present in the prior art, the present invention provides a new hat holding device wherein the same can be utilized for providing convenience for the user when storing and organizing multiple baseball hats while maintaining the shape of the brims.

It is therefore an object of the present invention to provide a new and improved hat holding device that has all of the advantages of the prior art and none of the disadvantages.

It is another object of the present invention to provide a hat holding device that allows a user to store one or more hats thereon.

Another object of the present invention is to provide a hat holding device that is portable and convenient for storage in a suitcase, duffle bag, or other similar travel bags.

Yet another object of the present invention is to provide a hat holding device that maintains the shape of the brim of one or more hats.

A further object of the present invention is to provide a hat holding device that allows a user to hold multiple hats arranged in a stacked orientation between a pair of gripping members.

Another object of the present invention is to provide a hat support device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
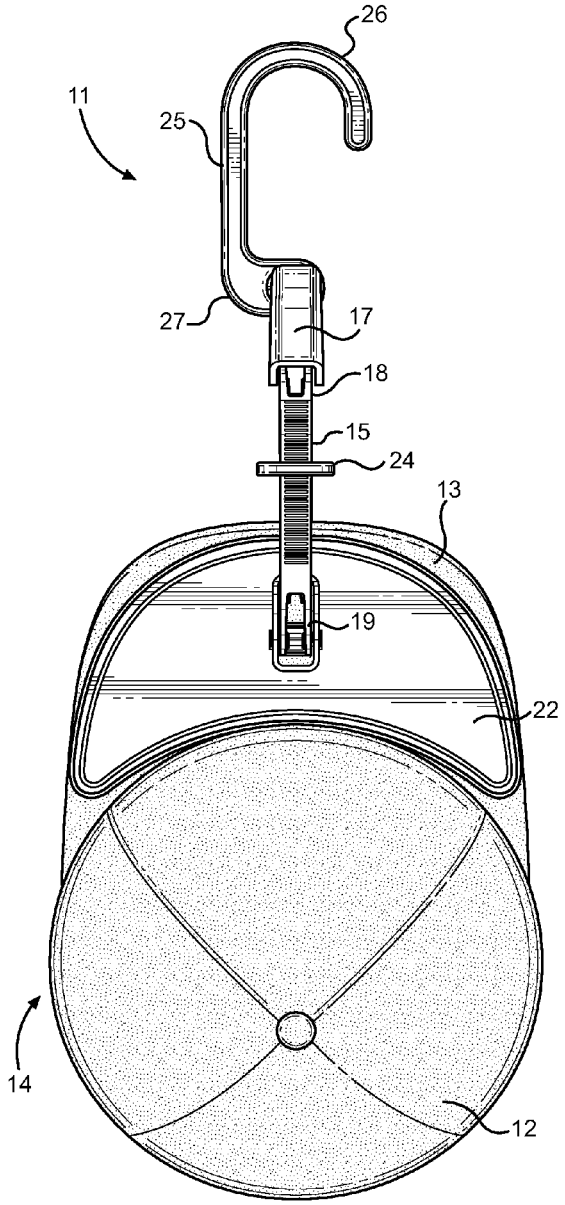
FIGS. 1A and 1B show views of the front and side of an embodiment of the hat holding device of the present invention.

Reference is made herein to the attached drawings. Like reference numerals are used throughout the drawings to depict like or similar elements of the hat holding device. For the purposes of presenting a brief and clear description of the present invention, the preferred embodiment will be discussed as used for holding several hats in a stacked orientation while maintaining the curvature of the brim of the hats. The figures are intended for representative purposes only and should not be considered to be limiting in any respect.

Figure 1B:
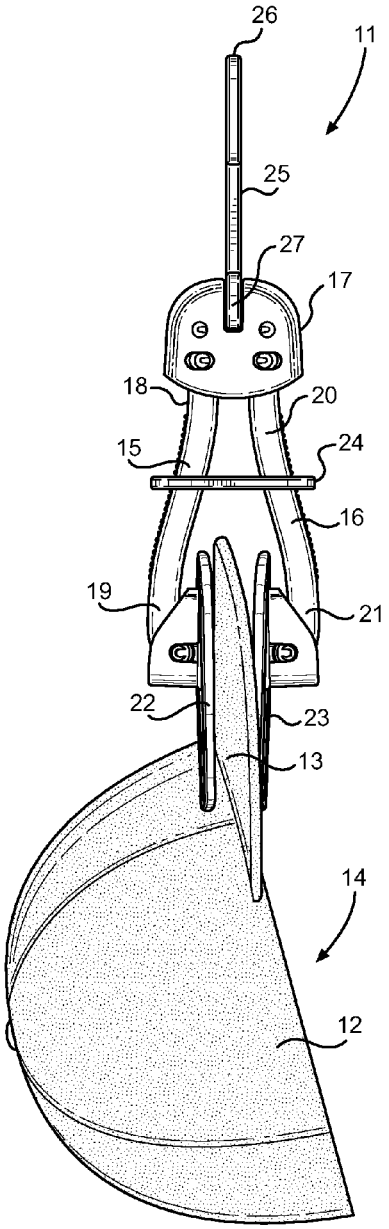

Referring now to FIGS. 1A and 1B, there are shown front and side views of an embodiment of the hat holding device of the present invention. The present invention comprises a first arm 15 having a first end 18 and a second end 19, and a second arm 16 having a first end 20 and a second end 21, wherein said first and second arms 15, 16 are pivotally secured at a first end 18, 20 to a housing 17. The housing 17 has an interior volume in which the first ends 18, 20 of the first and second arms 15, 16 are positioned. The first and second arms 15,16 are arranged such that they can pivot towards or apart from one another. The first and second arms 15,16 have an arcuate shape such that the first ends 18,20 of the arms are closer together than the second ends 19,21 thereof, as best shown by FIG. 1B.

A securing means 24 is disposed around the first arm 15 and the second arm 16. The securing means 24 comprises a loop having an interior area, and the securing means 24 is able to move along the length of the first and second arms 15, 16. As the securing means 24 moves along the first and second arms 15, 16 towards the second ends 19, 21 of the first and second arms 15, 16, the securing means 24 forces the first and second arms 15, 16 towards one another. In this way, the securing means 24 can be used to configure the hat holding device 11 in either an open or closed configuration.

The second end 19 of the first arm 15 is secured to a first gripping member 22, and the second end 21 of said second arm 16 is secured to a second gripping member 23. Preferably, the first and second arms 15, 16 are secured to the external surface of the gripping members 22, 23 so as to not interfere with the inner surfaces of the gripping members 22, 23, which are adapted for securing one or more hats therebetween. The gripping members 22, 23 are arranged such that the surfaces of the gripping members face one another. In this way, the gripping members 22, 23 can be used to hold the brim 13 of one or more hats 14 therebetween. The gripping members 22, 23 can be used to hold several hats 14 by stacking the hats on top of one another such that the brims 13 are aligned. Further, in some embodiments of the present invention, the gripping members 22, 23 are pivotally secured to the arms 15, 16 such that the gripping members can tilt or pivot.

In some embodiments of the present invention the gripping members 22, 23 are flat or planar so as to hold hats having a flat brim, or to flatten the brim of hats with curved brims. In other embodiments of the present invention, the gripping members 22, 23 are curved so that hats having curved brims can be secured therebetween, such that the gripping members serve to maintain the curved shape of the brims. Further, the gripping members 22,23 may have a crescent or semi-circular shape so that the gripping members 22,23 are shaped similarly to the shape of a brim of a hat, as shown in FIG. 1A. The gripping members 22, 23 are adapted to retain the curved brim of a hat even when the hat and hat holding device are placed in a suitcase with other clothes and belongings. The gripping members are composed of a rigid material in order to help maintain the curved shape of the brim of a hat secured therebetween.

A hook 25 is pivotally secured to an upper portion of the housing 17 and provides a means for allowing a user to hang the hat holding device 11 on a closet rod, closet bar, or other similar object. The hook 25 comprises a first end 26 and a second end 27. The first end 26 of the hook 25 has a curved shape that is adapted to be disposed over a closet rod, a hanging bar, or other similar object. The second end 27 of the hook 25 is pivotally secured to an upper portion of the housing 17. The hook 25 can be arranged in a folded or unfolded configuration. In the unfolded configuration, the hook 25 extends from the housing 17 and allows a user to position the hook on a closet rod or other similar object. To configure the hat holding device 11 in the folded configuration, the hook 25 is rotated about its connection to the housing 17 so that the hook 25 is folded downward and between the arms 15, 16 of the hat holding device 11.

Figure 2:
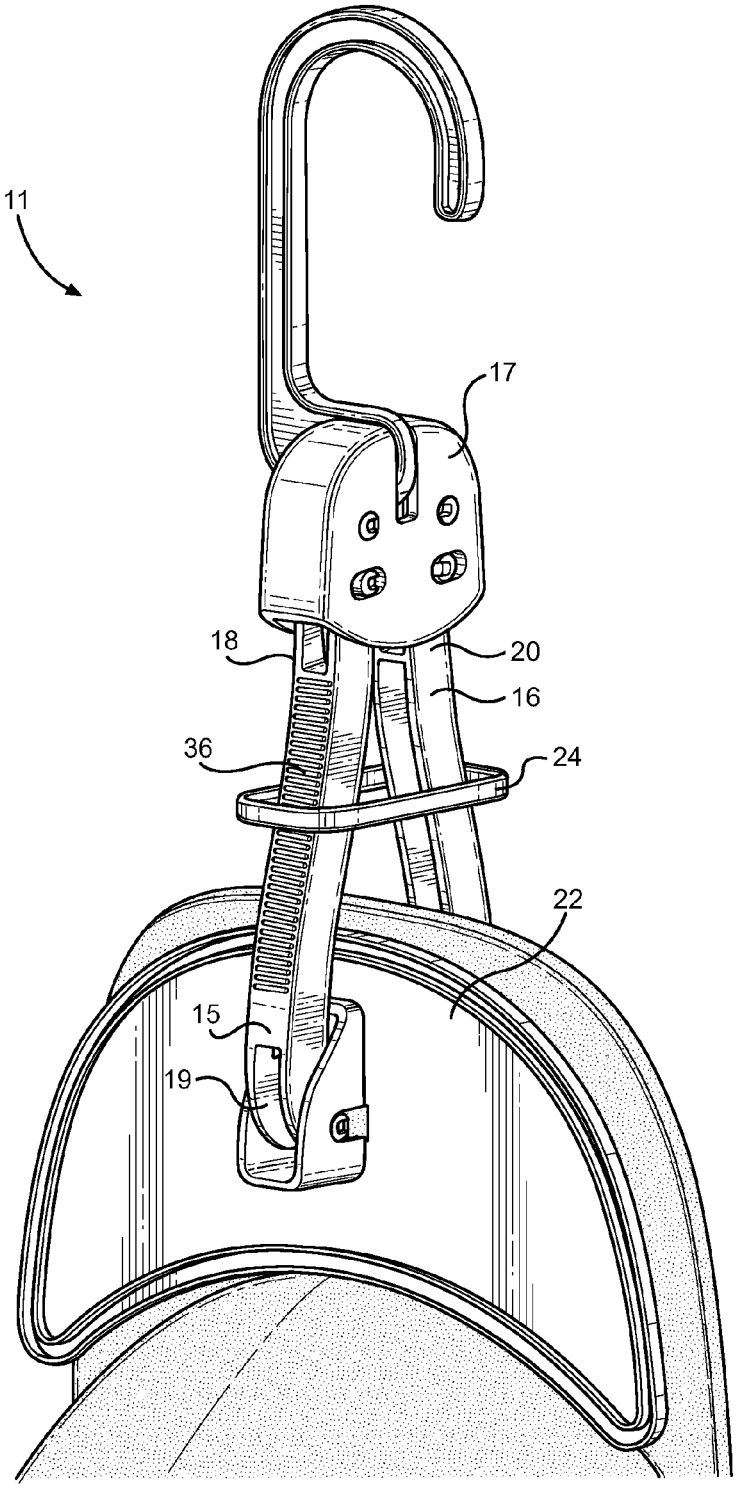
FIG. 2 shows a close-up view of the arms of the hat holding device of the present invention.

Referring now to FIG. 2, there is shown a close-up view of the arms of the hat holding device of the present invention. The first and second arms 15, 16 further comprise a plurality of ridges 36 arranged on an exterior surface thereof. The ridges 36 are adapted to engage with the securing means 24 such that the ridges 36 hold the securing means 24 in a particular position along the length of the first and second arms 15, 16. The securing means 24 comprises a loop having a substantially rectangular shape. As the securing means 24 is moved from the first end 18,20 of the arms 15,16 towards the second end of the arms, the securing means 24 forces the arms 15,16, and thus the gripping members together, in a closed configuration. In operation, a user can place one or more hats between the gripping members, and can then slide the securing means 24 towards the gripping members in order to secure the hat holding device in a closed configuration. The securing means 24 engages with the ridges 36 on the arms 15, 16 so that the securing means 24 is held in a desired position.

Figure 3A:
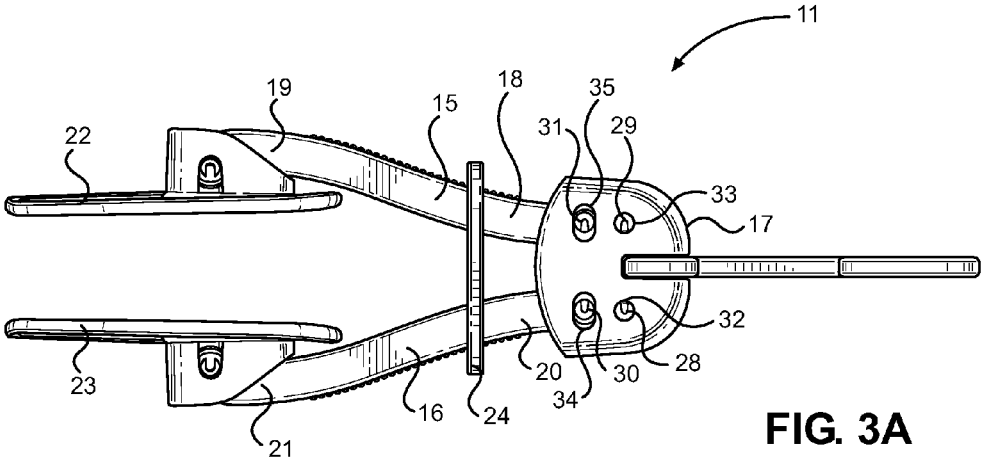
FIGS. 3A and 3B show side views of the hat holding device of the present invention in open and closed configurations, respectively.
Figure 3B:
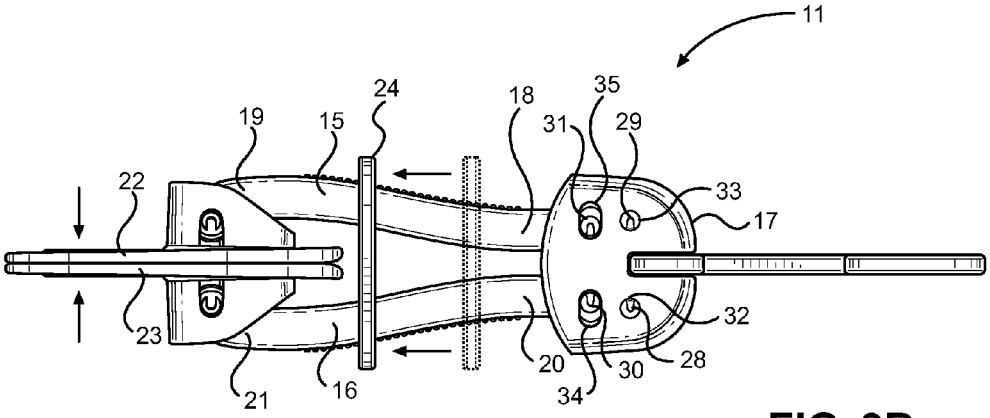

Referring now to FIGS. 3A and 3B, there are shown side views of the hat holding device of the present invention in open and closed configurations, respectively. The securing means 24 is adapted to move along the length of the first and second arms 15, 16 and controls the separation of the gripping members 22, 23. In an open configuration, where the gripping members 22, 23 are spaced from one another, the securing means 24 is disposed near the first ends 18, 20 of the first and second arms 15, 16. As the securing means 24 is moved towards the second end 19, 21 of the first and second arms 15, 16, the gripping members 22, 23 are forced towards one another due to the arcuate shape of the arms 15, 16. The arms 15, 16 are shaped such that the separation between the arms increases towards the second end of the arms 19, 21. In this way, the securing means 24 presses the arms 15,16 towards one another as the securing means 24 moves towards the second ends 19,21 of the arms.

The housing 17 comprises a pair of pivot apertures 32,33 thereon that engage with a pin 29 on said first arm 15 and a pin 28 on said second arm 16. The arms 15, 16 can pivot about the pins 28, 29 that are engaged with the pivot apertures 32, 33 on the housing 17. The pivotal connection allows the arms 15, 16 to rotate towards or apart from one another. However, this connection alone allows for unconstrained rotation of the arms about the pins 28, 29. Thus, the housing 17 additionally comprises a pair of constraining apertures 34, 35 thereon, which are adapted to engage with a pair of constraining pins 30, 31. The first arm 15 comprises a constraining pin 31 disposed thereon, and the second arm 16 comprises a constraining pin 30 thereon. The constraining pins 30, 31 are engaged with constraining apertures 34, 35 on said housing 17. The constraining apertures 34, 35 have an oblong or elongated shape that have a length that is greater than the diameter of the pins 30, 31 and a height substantially equal thereto with clearance. In this way, as the arms 15, 16 pivot on the pivot pins 28, 29 the constraining pins 30, 31 can move within the constraining apertures 34, 35. As the arms 15, 16 are separated from a closed configuration, the constraining apertures 34, 35 allow for a limited amount of pivotal movement, but prevent the arms 15, 16 from further rotation. The pins 30, 31 translate within the oblong apertures 34, 35 and are permitted to travel a given distance before encountering a stop—which are the outer extents of the oblong constraining apertures 34, 35. Once the pins 30, 31 reach the ends of the apertures 34, 35, the pins bear against the apertures and cannot travel any further in that given direction. In this way, the constraining apertures 34, 35 help to prevent excessive outward rotation of the arms. It is noted that the securing means 24 also helps to prevent over-rotation of the arms.

Figure 4:
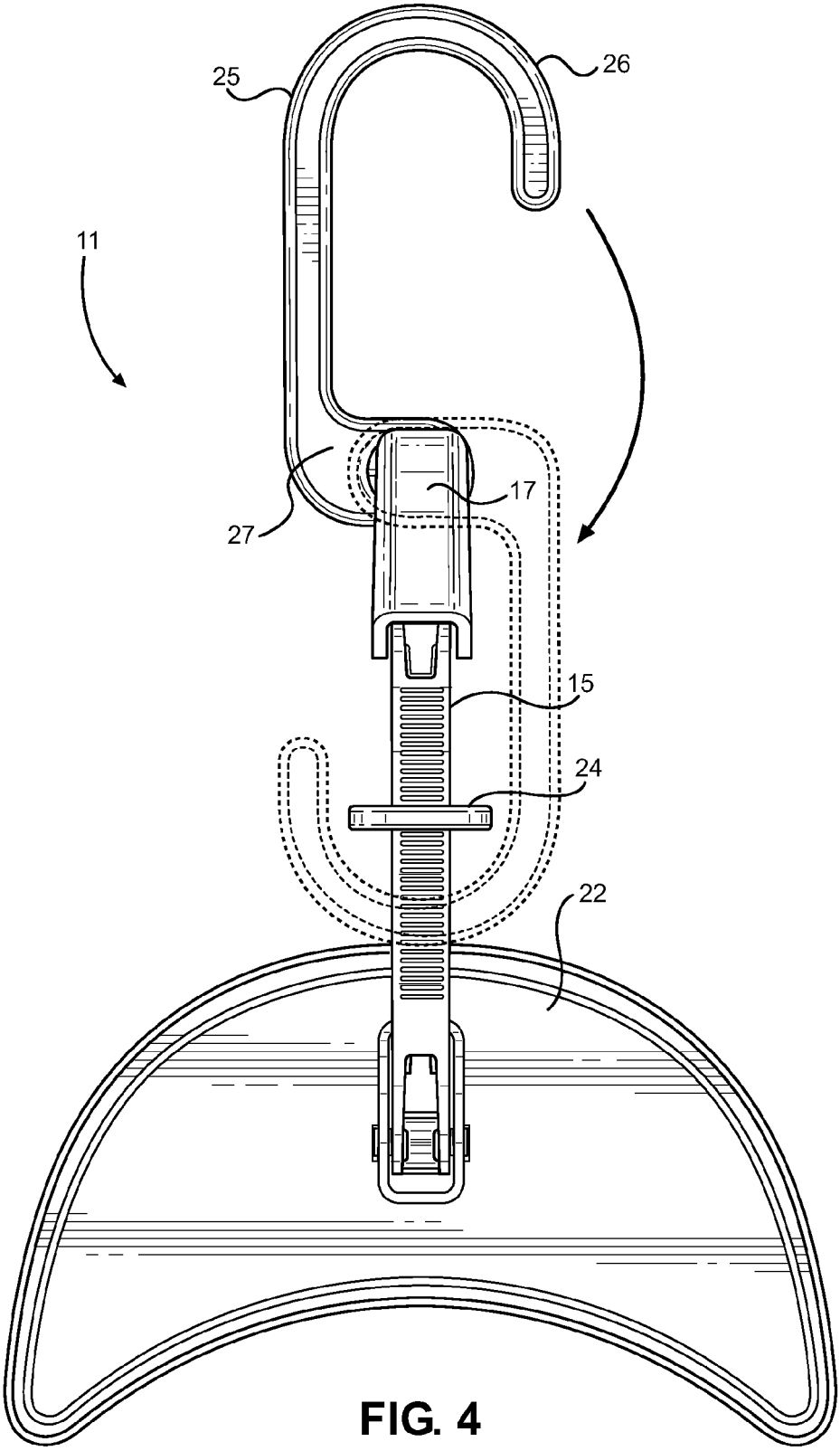
FIG. 4 shows a view of the hook of the present invention folded for storage of the hat support device.

Referring now to FIG. 4, there is shown a view of the hook of the present invention folded for storage of the hat holding device. The hook 25 is adapted to rotate about said housing 17 so that the hook 25 can be arranged between the arms of the hat holding device 11. This allows the hat holding device 11 to have a compact and low-profile shape that is convenient for travel. Further, folding the hook 25 prevents the hook 25 from catching on extraneous objects.

In the folded configuration, the hook 25 is rotated roughly 180 degrees from the unfolded configuration wherein the hook 25 is used to hang the hat support device 11 on a closet rod or bar. The hook 25 is sized so that when it is rotated in a folded configuration, the hook 25 does not interfere with the gripping members 22. Further, the upper end 26 of the hook 25 wraps around the securing means 24 disposed around the arms 15, 16 of the hat holding device 11.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hat holding device, comprising:

a first arm and a second arm each having a first end and a second end;

each of said first arm and said second arm being pivotally secured to a housing at said first end such that said first arm and said second arm can rotate toward or apart from one another;

a first gripping member secured to said second end of said first arm, and a second gripping member secured to said second end of said second arm, wherein said first gripping member and said second gripping member are adapted to sandwich the brim of a hat therebetween;

a hook pivotally secured to an upper portion of said housing and adapted to rotate downward and between said first arm and said second arm for storage;

a securing means comprising a loop having an open interior area wherein said securing means is disposed around said first arm and said second arm and is adapted to slide therealong;

wherein said first arm is pivotally secured to said first gripping member, and said second arm is pivotally secured to said second gripping member.

2. The hat holding device of claim 1, wherein:

said first arm and said second arm each comprise an exterior surface;

wherein said exterior surface of said first arm and said exterior surface of said second arm each comprise a plurality of ridges arranged transversely thereon;

wherein said ridges are adapted to engage with said securing means.

3. The hat holding device of claim 1, wherein said first gripping member and said second gripping member are substantially flat.

4. The hat holding device of claim 1, wherein said first gripping member and said second gripping member are curved.

5. The hat holding device of claim 1, wherein said first gripping member and said second gripping member have a crescent shape.

6. The hat holding device of claim 1, wherein each of said first arm and said second arm comprise an arcuate shape such that said first arm and said second arm is closer together at said first end, and wherein each of said first arm and said second arm is farther from one another at said second end.

7. The hat holding device of claim 1, wherein said first end of said first arm further comprises a pivot pin;

wherein said first end of said second arm further comprises a pivot pin;

wherein said pivot pin of said first arm and said pivot pin of said second arm engage with a pair of pivot apertures disposed on said housing.

8. A hat holding device, comprising:

a first arm and a second arm each having a first end and a second end;

each of said first arm and said second arm being pivotally secured to a housing at said first end such that said first arm and said second arm are adapted to rotate toward or apart from one another;

a first gripping member secured to said second end of said first arm, and a second gripping member secured to said second end of said second arm, wherein said first gripping member and said second gripping member are adapted to sandwich the brim of a hat therebetween;

a hook pivotally secured to an upper portion of said housing and adapted to rotate downward and between said first arm and said second arm for storage;

a securing means comprising a loop having an open interior area wherein said securing means is disposed around said first arm and said second arm and is adapted to slide therealong;

wherein each of said first arm and said second arm is partially disposed within said housing and is pivotally secured therein.

9. The hat holding device of claim 8, wherein:

said first arm and said second arm each comprise an exterior surface;

wherein said exterior surface of said first arm and said exterior surface of said second arm each comprises a plurality of ridges arranged transversely thereon;

wherein said ridges are adapted to engage with said securing means.

10. The hat holding device of claim 8, wherein said first gripping member and said second gripping member are substantially flat.

11. The hat holding device of claim 8, wherein said first gripping member and said second gripping member are curved.

12. The hat holding device of claim 8, wherein said first gripping member and said second gripping member have a crescent shape.

13. The hat holding device of claim 8, wherein said first arm and said second arm comprise an arcuate shape such that said first arm and said second arm are closer together at said first end, and wherein said first arm and said second arm are farther from one another at said second end.

14. The hat holding device of claim 8, wherein said first end of said first arm further comprises a pivot pin;

wherein said first end of said second arm further comprises a pivot pin;

wherein said pivot pin of said first arm and said pivot pin of said second arm engage with a pair of pivot apertures disposed on said housing.

15. A hat holding device, comprising:

a first arm and a second arm each having a first end and a second end;

each of said first arm and said second arm being pivotally secured to a housing at said first end such that said first arm and said second arm are adapted to rotate toward or apart from one another;

a first gripping member secured to said second end of said first arm, and a second gripping member secured to said second end of said second arm, wherein said first gripping member and said second gripping member are adapted to sandwich the brim of a hat therebetween;

a hook pivotally secured to an upper portion of said housing and adapted to rotate downward and between said first arm and said second arm for storage;

a securing means comprising a loop having an open interior area wherein said securing means is disposed around said first arm and said second arm and is adapted to slide therealong;

said first end of said first arm further comprises a constraining pin and said first end of said second arm further comprises a constraining pin;

said housing further comprising a first constraining aperture and a second constraining aperture;

said first arm constraining pin being adapted to engage with said first constraining aperture;

said second arm constraining pin being adapted to engage with said second constraining aperture;

wherein said first constraining apertures and said second constraining apertures are adapted to limit the pivotal motion of said first arm and said second arm.

16. The hat holding device of claim 15, wherein:

said first constraining apertures and said second constraining apertures are elongated apertures adapted to allow said constraining pins to travel a given distance therein and thereby allow limited movement of said first arm and said second arm.

17. The hat holding device of claim 15, wherein:

said first arm and said second arm each comprise an exterior surface;

wherein said exterior surface of said first arm and said exterior surface of said second arm each comprise a plurality of ridges arranged transversely thereon;

wherein said ridges are adapted to engage with said securing means.

18. The hat holding device of claim 15, wherein said first gripping member and said second gripping member are substantially flat.

19. The hat holding device of claim 15, wherein said first gripping member and said second gripping member are curved.

20. The hat holding device of claim 15, wherein said first gripping member and said second gripping member have a crescent shape.

21. The hat holding device of claim 15, wherein said first arm and said second arm comprise an arcuate shape such that said first arm and said second arm are closer together at said first end, and wherein said first arm and said second arm are farther from one another at said second end.

22. The hat holding device of claim 15, wherein said first end of said first arm further comprises a pivot pin;

wherein said first end of said second arm further comprises a pivot pin;

wherein said pivot pin of said first arm and said pivot pin of said second arm engage with a pair of pivot apertures disposed on said housing.

* * * * *